United States Patent [19]

Brown et al.

[11] Patent Number: 4,951,593

[45] Date of Patent: Aug. 28, 1990

[54] ANCHOR WITH SNAG RELEASE MECHANICS

[76] Inventors: Kenneth R. Brown; Phyllis B. Brown, both of 1154 Link St., Corning, Calif. 96021

[21] Appl. No.: 393,800

[22] Filed: Aug. 15, 1989

[51] Int. Cl.[5] ..... B63B 21/24

[52] U.S. Cl. ..... 114/297; 114/299

[58] Field of Search ..... 114/297, 298, 299

[56] References Cited

U.S. PATENT DOCUMENTS

| | | | |
|---|---|---|---|
| Re. 31,654 | 8/1984 | Fasco | 114/297 |
| 594,769 | 11/1897 | Ward | 114/298 |
| 2,797,658 | 9/1957 | Doty | 114/298 |
| 2,816,522 | 12/1957 | Root | 114/299 |
| 2,870,731 | 1/1959 | Marshburn et al. | 114/298 |
| 2,914,015 | 11/1959 | Farr | 114/298 |
| 2,981,219 | 4/1961 | Winslow | 114/298 |
| 3,030,907 | 4/1962 | Rosselle | 114/299 |
| 3,182,625 | 5/1965 | White | 114/299 |
| 3,249,082 | 5/1966 | Noel et al. | 114/298 |
| 3,491,712 | 1/1970 | Ross | 114/298 |
| 4,134,355 | 1/1979 | Carruthers | 114/297 |
| 4,386,575 | 6/1983 | Brown | 114/299 |
| 4,417,538 | 11/1983 | El-Ramey | 114/298 |

FOREIGN PATENT DOCUMENTS

| | | | |
|---|---|---|---|
| 0190597 | 7/1989 | Japan | 114/297 |

*Primary Examiner*—David H. Brown

[57] ABSTRACT

A two piece shank structure releasably retains a single central shank tube detachable from the shanks. The shanks are affixed in position on the surface of two double edged flukes. The double edged flukes are attached to a main fluke shaft. The anchor line extends from the boat through the central shank tube where it attaches to a U-shaped bracket. The U-shaped bracket is attached centrally to the main fluke shaft by a rotatable collar. Both shanks are manufactured with an inherent spring biasing in the material, allowing them to be slightly separated for snap in connection of the central shank tube, and also maintains pressure against the central shank tube retaining it in position under normal use. Once the anchor has become snagged under a log or similar underwater snag it may be retrieved by pulling the anchor line at an angle relative to the shanks with the pull needing to be generally opposite in direction to which the anchor is suspected of sliding under a snag. With sufficient tension sometimes coupled with a jerk of the anchor line, the central shank tube will pop-out from between the two spring biased shanks allowing the anchor line to pivot with the U-shaped bracket. The anchor line through the middle of the shank tube and attaching to the rotatable U-shaped bracket allows the anchor to be pulled back out from underneath a snag in the opposite direction from which it was moving when snagged.

4 Claims, 4 Drawing Sheets

ANCHOR WITH SNAG RELEASE MECHANICS

BACKGROUND OF THE INVENTION

1. Field of the Invention:

This invention relates generally to boat anchors and more particularly to an anchor having release mechanics enabling it to be retrieved from underwater snags when normal retrieval methods are not possible.

2. Description of the Prior Art:

Boat anchors have been in use for many years to stabilize boats in the water. An anchor is generally a large, heavy, double hooked device which, when dragged by the boat, embeds the ends of the hooks or flukes into the floor of a sea, lake, or river bracing the boat. The floors of these water ways however, contain many natural as well as man-made obstacles with which anchors can become entangled. The general rule of practice when an anchor cannot be dislodged by simple winching, is to reverse the direction of the boat, approach the anchor from above or more often, the opposite side, and pull the anchor out backwards. Should the end portion or bill of the fluke be embedded, for instance under a log, this normal removal procedure would more than likely prove useless. This is due to the fact that when the upper shank portion of the anchor is pulled in the opposite direction, the fluke is actually driven further upward under and around the log. The need therefore developed for an anchor which could be easily retrieved once snagged. Some of the past art retrievable anchors similar to ours have shanks or flukes which can be disengaged from a stationary position. The following past art patented devices are indicative of these types of disengageable anchors:

The Brown patent, issued Jun. 7, 1983, U.S. Pat. No. 4,386,575, shows a flat fluke anchor having an accessory extracting cable in conjunction with the anchor cable. When embedded, the extracting cable is activated, changing the angle of the flukes and allowing them to be extracted from the sea floor.

El-Ramey was granted U.S. Pat. No. 4,417,538, for anchor which utilizes a vertical pull to break a replaceable tie, releasing the stationary positioning of the flukes. Another tie must later be re-applied to the anchor.

The Fasco device, U.S. Pat. No. Re. 31,654, shows an anchor where the flukes are automatically disengaged when the shank is tipped or pulled at a certain angle The U.S. patent granted to Marshburn et al, U.S. Pat. No. 2,870, 731, shows a spring biased shank, whereby excessive pulling force compresses the spring and disengages the flukes.

White was granted U.S. Pat. No. 3,182,625, for an anchor having a slidably affixed anchor line, allowing the point or direction of pulling force to be altered.

A snag-resistant anchor was patented by Carruthers, U.S. Pat. No. 4,134,355, which shows a bifurcated outer shaft with a single center shaft which disengages longitudinally with the first, altering the angle of the flukes.

Ross was granted U.S. Pat. No. 3,491,712, for a self-releasing anchor which disengages the flukes by manipulation of a secondary anchor line.

Several of the past art anchors utilize a secondary anchor line in addition to the main anchor cable, to activate the release mechanisms. The additional anchor line presents the increased risk of entanglement of the two lines.

Other past art devices use engagement mechanics which are not re-usable once detached. Ties or connectors must be kept on hand to re-affix the shaft or flukes in a stable position. This is not only inconvenient, but should the extra supply of ties run out or become misplaced, the anchor would be rendered generally useless.

Other past art anchors have detachable mechanisms similar to our device which are activated when the anchor line is at a specific angle to the shank. Although these anchors are somewhat similar, none are structured or function in the same manner as our device. Our anchor is simple in design and function, and provides additional benefits and advantages not found in the past art devices. Our anchor is also specifically designed to be able to be manufactured relatively inexpensively and give years of trouble free service.

SUMMARY OF THE INVENTION

We provide a snag free boat anchor having a two piece, elongated shank structure which releasably retains a single central shank tube detachable from the shanks. The shanks are affixed in position on the top surface of two double fluke structures, one shank to each double fluke structure. The double fluke structures are attached with the points transverse to a main fluke shaft, one double fluke structure adjacent each end of the main fluke shaft. The anchor chain extends from the boat through the central shank tube which is normally retained between the two shanks at the upper ends thereof. Below the central shank tube, the anchor chain attaches to a U-shaped bracket. The U-shaped bracket is attached centrally to the main fluke shaft by a rotatable collar or slip ring. Both shanks are manufactured with an inherent spring biasing in the material, allowing the shanks to be slightly separated for snap in connection of the central shank tube. The spring biasing of the shanks also maintains pressure against the central shank tube retaining it in position under normal use.

Once our anchor has become snagged under a log or similar underwater snag, it may be retrieved by pulling the anchor chain at an angle relative to the shanks preferably in a generally opposite direction to which the anchor is suspected of sliding under a snag. With sufficient tension, sometimes coupled with a jerk of the anchor chain, the central shank tube will pop-out from between the two spring biased shank supports allowing the anchor chain to pivot along with the U-shaped bracket on the main fluke shaft. The anchor chain extending through the middle of the detached central shank tube and attaching to the rotatable U-shaped bracket will rotate due to the slip ring, allowing the angle of the pull against the main fluke shaft and fluke structures to be altered. The altered angle of the pull usually allows the anchor to be pulled back out from underneath a snag in the opposite direction from which it was moving when it became snagged. The pull is at a slightly upward and horizontal direction, usually at a proper angle to cause the anchor to slide out from underneath the snag. The rotatable slip ring around the main fluke shaft allowing the altered angle of pull, helps prevent the pulling pressure direction from causing the fluke or flukes caught under the snag from tipping upward causing further wedging of the fluke or flukes against the snag.

The pulling force required to disengage the central shank tube may be regulated by increasing or decreasing the pressure exerted against the top portion of the central shank tube by merely bending the shank inward or outward slightly, by increasing or decreasing the external diameter of the central shank tube relative to the space between the shanks, or by increasing the rigidity of the shanks. The anchor is best manufactured at the factory with a proper release pressure setting of the central shank tube relative to a certain boat size and weight.

Once the anchor with the disengaged central shank tube has been retrieved, a person can force the shank tube back between the two spring biased shanks by hand, with foot pressure, or tightenable clamping devices. The shanks will spread slightly allowing the central shank tube to snap into inward facing U-shaped channels at the upper ends of the shanks.

Our anchor is simple in design, having fewer and less complicated components than past art anchors. Since the water and harsh treatment received by anchors increase the chance of corrosion and damage to small intricate parts, it is quite an advantage to achieve a function using fewer and less delicate parts than similar past art devices. Our anchor is also inexpensive to manufacture due to the few and simple rugged parts used.

Therefore, it is a primary object of our invention to provide an anchor which can be easily retrieved once hungup on an underwater snag.

A further object of our invention is to provide a snag free anchor having a pivotal central shank assembly which allows the direction of pulling force on the anchor to be altered.

Another object of our invention is to provide a snag free anchor having disengagement mechanics which can be activated by merely pulling the anchor line at an angle and predesignated pressure to the shanks.

A still further object of our invention is to provide a snag free anchor which is simple in function and design, and is inexpensive to manufacture when compared to existing similar anchors.

An even still further object of our invention is to provide a snag free boat anchor having disengaging mechanics allowing the anchor to be retrieved from underneath an underwater snag with the disengaging mechanics being completely reuseable without having to be replaced with new parts.

Other objects and advantages will be made known with a reading of the remaining specification and comparison with the accompanying numbered drawings.

DESCRIPTION OF THE PREFERRED EMBODIMENT

Figure 1:
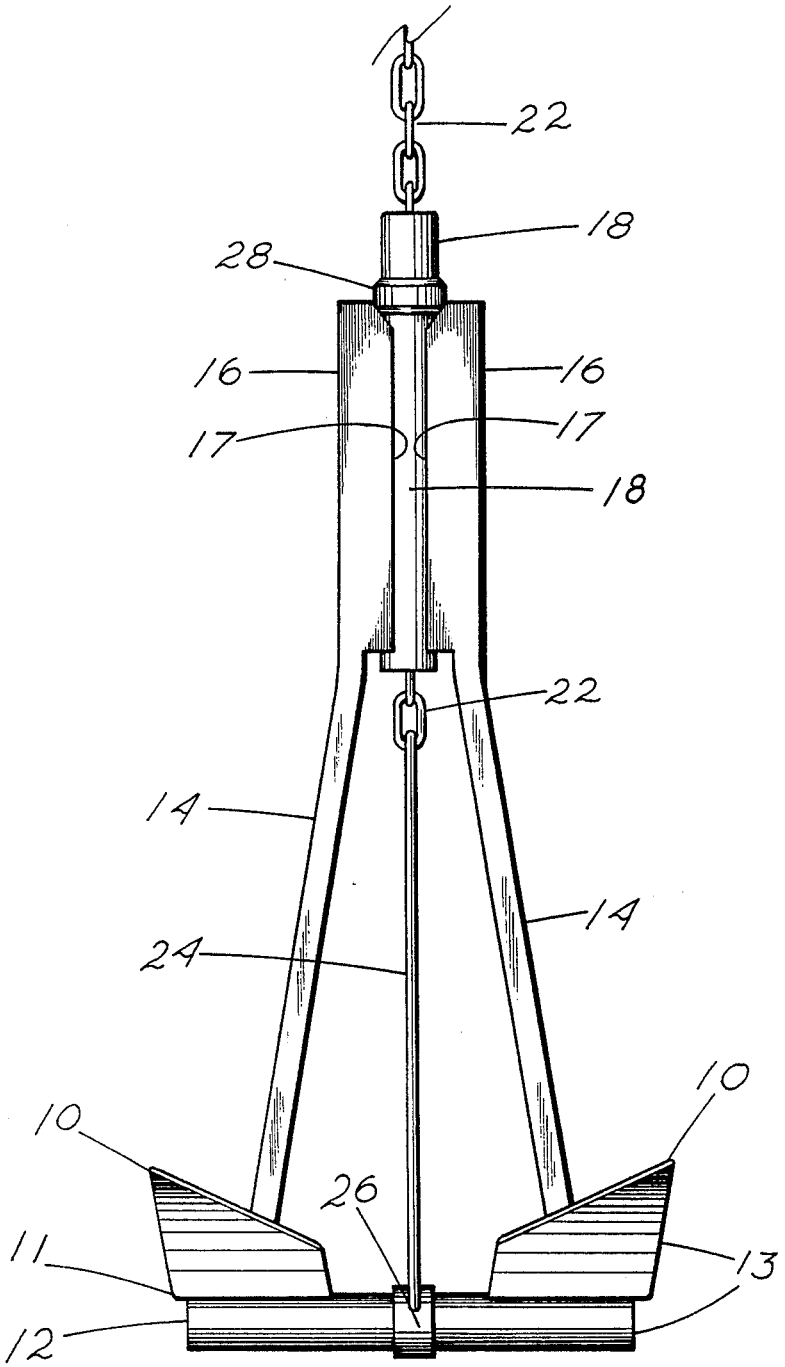
FIG. 1 is an assembled frontal view of the invention as it is normally used. The shanks are shown retaining the central shank tube. The anchor chain or line is shown extending through the center of the central shank tube and attaching to the U-shaped bracket.
Figure 2:
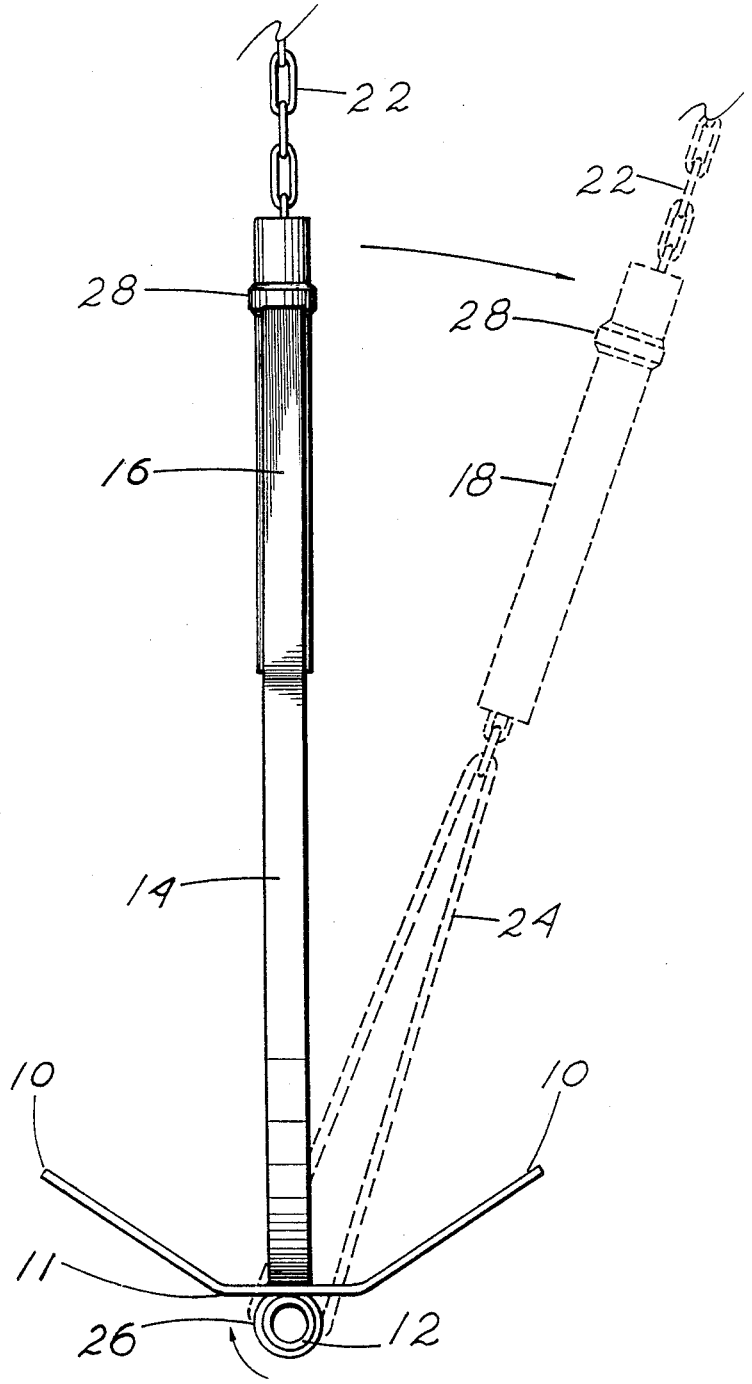
FIG. 2 is a side view thereof, illustrating the detachment of the central shank tube from the shanks, and the pivotally attached U-shaped bracket.
Figure 3:
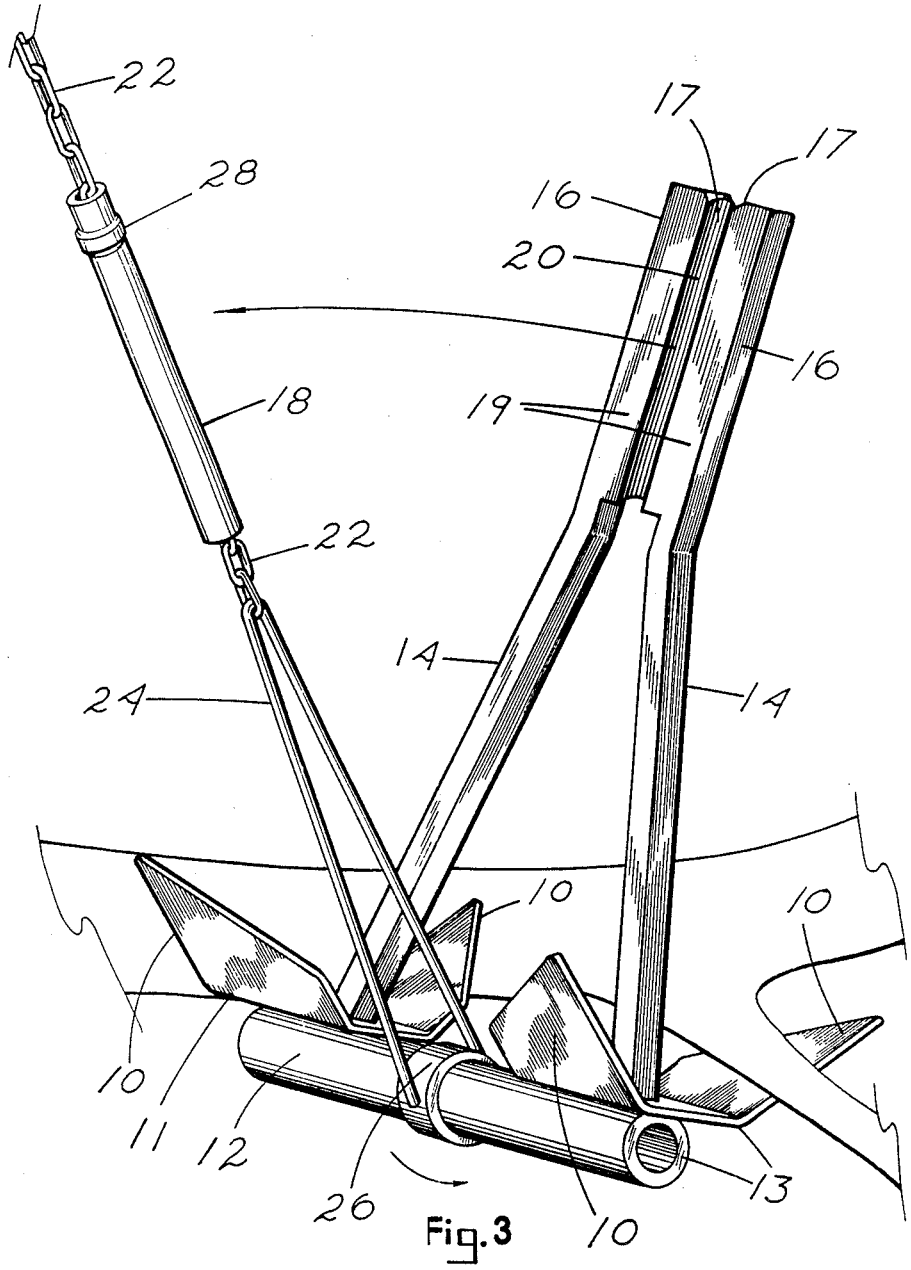
Fig 3 is a perspective view depicting one fluke the anchor snagged on an underwater log and the central shank tube detached and in position to retrieve the anchor in the reverse direction from which it was caught. It should be noted that the angle of pull being exerted to the anchor chain will pull or slide the fluke from under the log in about the reverse direction to that which the fluke was pulled under the log without causing the caught fluke to tip further upward causing it to be more securely caught.

Referring now to the drawings where the preferred embodiment of the invention is illustrated. The anchor, manufactured preferablyly of steel, is structured with two double fluke structures 11 having two flukes 10 each, which are rigidly mounted parallel to one another, transversely to a single cylindrical main fluke shaft 12, one double fluke structure 11 adjacent each end of shaft 12 as shown in FIG. 1 and 3. Main fluke shaft 12 with the attached double fluke structures 11 is designated the main body 13 of the anchor. Each double fluke structure 11 is a generally flat elongated section of metal having two elongated parallel sides and two somewhat upwardly angled pointed distal ends with the pointed distal ends extending perpendicular to main fluke shaft 12 as shown in FIG. 3. Each double fluke structure 11 has a top and bottom surface with the bottom surface being welded to the top or upper surface of main fluke shaft 12 as shown in FIG. 1, 2, and 3. The distal ends of flukes 10 being angled upward are adapted to embed into the lake bed, sea bed, or sometimes under a log as shown in FIG. 3.

Figure 4:
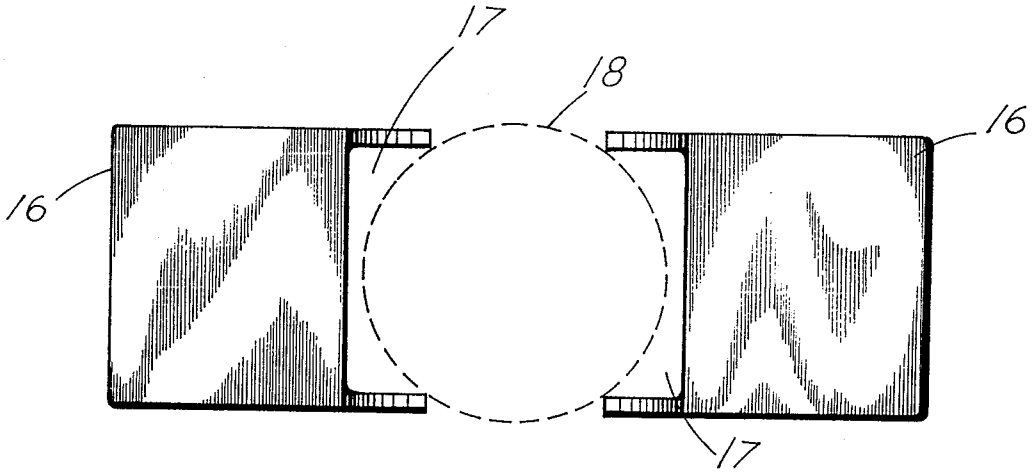
FIG. 4 is a top view of the two spring biased shanks showing two generally U-shaped inward facing channels adapted to releasably retain the round central shank tube shown in dotted lines. The anchor line is not shown extending through the center of the central shank tube as is normally the situation.

The top central surfaces of each double fluke structure 11 is rigidly affixed with one elongated shank 14 each. Both shanks 14 are elongated rectangular metal tubes or bars which angle upward and inward from the surface of each double fluke structure 11 and generally perpendicular to main fluke shaft 12. The upper distal ends of shanks 14 are positioned parallel to one another as shown in FIG. 1 and 2. Shanks 14 are sized, shaped, and made of a metal to allow a degree of flexibility and resiliency. The upper distal ends of shanks 14 are designated as central shank tube supports 16. Each central shank support 16 is structured with one generally U-shaped channel 17 on each inward facing surface. Channels 17 are spaced slightly apart, and with the wide side of the "U" of channels 17 facing inward toward each other, in longitudinal parallel alignment with each other, and in longitudinal alignment with shanks 14 as shown in FIG. 1 and 4. The "U" shape of channels 17 is a specifically shaped contoured surface with the two inward faced surfaces forming a specifically shaped open space between the two channels 17. In the relaxed position 19 as shown in FIG. 3, a narrow slot 20 is left between the inward most edges of the "U" of channels 17 on both sides of central shank tube supports 16.

Central shank tube 18 is a length of hollow, rigid metal tubing sized slightly externally larger than the narrow slot 20 between the relaxed U-shaped channels 17. Central shank tube 18 being diametrically round, is specifically contoured and sized to be able to be forced between the narrow slot 20, spreading apart channels 17 to snap between the two U-shaped channels 17 and be releasably retained between the two channels 17 as shown in FIG. 4. Central shank tube 18 being round allows for smooth sliding of the tube 18 into and out of channels 17 through narrow slot 20 with sufficient pressure to spread shanks 14 slightly.

Adjacent the upper edge of central shank tube 18 is a widened shoulder area designated as central shank aligner 28. Shank aligner 28 helps to correctly longitudinally align or position central shank tube 18 for insertion between shanks 14, with the lower edge of shank aligner 28 resting on the top surfaces of central shank supports 16 as shown in FIG. 1. Loosely housed within the interior of central shank tube 18 is anchor line 22. One end of anchor line 22 is adapted to attach to a boat. The opposite end or bottom end of line 22 extends out the bottom of central shank tube 18 a short distance and is attached to the upper end of U-shaped bracket 24. U-shaped bracket 24 is an elongated cylindrical metal rod folded in half, with the upper end forming the loop to which anchor line 22 is affixed. The lower ends of U-shaped bracket 24, angled slightly outward, are affixed to the exterior surface of a collar 26. Collar 26 is a short tubular metal ring or collar rotatably affixed centrally around the exterior of main fluke shaft 12 between the double fluke structures 11 as shown in FIG. 1 and 3.

In use, when one or more flukes 10 of the anchor has become snagged on underwater debris as shown in FIG. 3, the boat is turned around and headed in the opposite direction to which the anchor is anticipated to have been moving when it became caught. When correctly positioned, tension is applied to anchor line 22. The spring biased pressure retaining central shank tube 18 between channels 17 is a predetermined pressure based on the stiffness of shanks 14 and the width of narrow slot 20. When sufficient tension is applied to anchor line 22 at a angle relative to shanks 14 as shown in FIG. 2 and 3, central shank tube 18 disengages from connection between the two spring biased shanks 14, snapping out of channels 17 through narrow slot 20. The inherent spring biasing incorporated into the structure and steel of the shanks 14, enables both shank 14 along with attached U-shaped channels 17 to be separated, allowing the round smooth walled central shank tube 18 to be popped-out from between the U-shaped channel 17. Shanks 14 then return to relaxed position 19. Central shank tube 18, anchor line 22, U-shaped bracket 24 now pivot outward on collar 26 away from shanks 14 allowing the pull on the main body 13 snagged anchor to be at an altered angled direction than would be the angle or pull if the central shank tube 18 were not disengaged from shanks 14. Anchor line 22 is now in generally straight alignment with the point of attachment on main fluke shaft 12 allowing the caught fluke to be extracted in the reverse direction from which it was dragged into the underwater snag without the fluke 10 from being further tipped upward causing it to be more tightly caught. Once aboard the boat, central shank tube 18 can be repositioned by manually forcing central shank tube 18 between the two U-shaped channels 17. The spring biasing of shanks 14 allows them to be separated for snap in connection of central shank tube 18 back in between U-shaped channels 17. Either hand or foot pressure is used force the cylindrical shank tube 18 back between channels 17. The spring biasing of shanks 14 return channels 17 tightly onto shank tube 18. Pressure is therefore exerted against the sides of shank tube 18 to maintain it in position for normal use.

After reading this disclosure it will be obvious to one skilled in the art that various alterations may be made in our anchor and still produce the same functional results using the same principles. The above disclosure of this invention has been presented by way of example and is to be considered only illustrative of the principles of the device and should be more than adequate for one skilled in the art to both build and use our invention.

What we claim as our invention:

1. A boat anchor having release mechanics adapted to allow retrieval of said anchor with at least one fluke of a double fluke structure of said anchor caught underneath an underwater snag comprising;

a main fluke member having at least one said double fluke structure rigidly attached thereto;

said main fluke shaft member with said attached double fluke structure forming a main body of said anchor;

two elongated shanks having a first and second end each; each elongated shank attached at said first end to said main body of said anchor, said two shanks extending generally perpendicular from said main fluke shaft member;

said second end of each said shank having a generally contoured surface with each contoured surface facing the other contoured surface forming a contoured space between said second ends of said two shanks;

a contoured member cooperatively shaped and sized to be inserted into and releasably retained within said contoured space between said two shanks;

said contoured space adapted to retain said contoured member within said contoured space by spring biased pressure;

said spring biased pressure provided by material composition and structure of said two shanks allowing said two shanks to temporarily separate and return;

an anchor line attached by rotational attachment means to said main fluke shaft member;

said contoured member positioned on said anchor line with said positioning adapted to allow said retention of said contoured member in said contoured space;

said contoured member when retained in said contoured space adapted to be released from said contoured space by a predetermined tension applied to said anchor line causing said two shanks to separate allowing said release of said contoured member;

said contoured member when released from said contoured space adapted to allow rotation of said attached anchor line on said main fluke shaft member with said rotation adapted to alter and angle said tension relative to said anchor;

said altered angled tension applied to said boat anchor adapted to allow said caught fluke of said double fluke structure of said anchor to be pulled from underneath said underwater snag in a generally reverse direction from which it became caught.

2. The boat anchor as described in claim 1 wherein said contoured surfaces forming said contoured space is a pair of U-shaped channels in longitudinal alignment with each other and said two elongated shanks, one channel on each said second end of each said shank; said contoured member is a tubular structure adapted to snap-in between said U-shaped channels.

3. The boat anchor as described in claim 1 wherein said rotational attachment means includes a collar rotationally attached around said main fluke shaft, said collar having a U-shaped bracket attached thereto, said anchor line being attached to a closed end of said U-shaped bracket.

4. The boat anchor as described in claim 1 wherein said two elongated shanks are manufactured of tubular steel having a degree of resiliency.

* * * * *